US005195263A

United States Patent [19]

Huang

[11] Patent Number: 5,195,263

[45] Date of Patent: Mar. 23, 1993

[54] PICTURE FRAME

[76] Inventor: Harrison Huang, No. 23, Lin T'So Rd., Shengkang, Taiwan

[21] Appl. No.: 842,671

[22] Filed: Feb. 27, 1992

[51] Int. Cl.[5] ..... A47G 1/06

[52] U.S. Cl. ..... 40/152.1; 40/600; 248/467; 248/473

[58] Field of Search ..... 40/152, 152.1, 158.1, 40/600, 621, 156, 120; 248/467, 469, 473

[56] References Cited

U.S. PATENT DOCUMENTS

| | | | |
|---|---|---|---|
| 1,778,728 | 10/1930 | Raskin | 40/152.1 X |
| 1,829,360 | 10/1931 | Lambert | 248/273 |
| 3,298,124 | 1/1967 | Jahn | 40/156 |
| 3,553,873 | 1/1971 | Weston | 40/156 |

FOREIGN PATENT DOCUMENTS

| | | | |
|---|---|---|---|
| 3005628 | 9/1980 | Fed. Rep. of Germany | 40/156 |
| 2222945 | 3/1990 | United Kingdom | 40/152 |

*Primary Examiner*—Kenneth J. Dorner
*Assistant Examiner*—Brian K. Green
*Attorney, Agent, or Firm*—Browdy and Neimark

[57] ABSTRACT

A picture frame comprises a frame, a back plate, a face plate, and a base. The frame of iron material provides an ornamental border surrounding a picture intended to be displayed. The back plate is made of a soft magnetic plate and is attached to one side of the frame by virtue of its magnetism. The face plate of transparent material is kept between the frame and the back plate in such a manner that it permits a picture intended to be displayed to be placed between it and the back plate. The base made of a flat plate is provided thereon with a retaining portion made up of a left retaining strip, a right retaining strip and a middle retaining strip, each of which is arranged in such a manner that it forms a predetermined angle with the base. The left and the right retaining strips are aligned, while the middle retaining strip is arranged slightly toward the rear side of the base.

1 Claim, 2 Drawing Sheets

PICTURE FRAME

BACKGROUND OF THE INVENTION

The present invention relates to a picture frame, and more particularly to a magnetic picture frame.

A desktop picture frame of prior art is generally composed of a frame containing a transparent glass and a back plate, between which a picture intended to be displayed is kept. The back plate is provided with four positioning blocks, each of which can be rotated at will for an angle of 90 degrees so as to permit the back plate to be positioned securely. The back plate is further provided with a support leg to keep the picture frame from falling and to allow the picture frame to stand on the desk in such a manner that it forms a desired angle with the desk top on which it is placed.

Such prior art picture frame described above is defective in that its back plate must be removed by rotating each of the four positioning blocks for an angle of 90 degrees each time when one wishes to display another picture, and that it does not always fit the picture having a rectangular shape.

SUMMARY OF THE INVENTION

It is therefore the primary objective of the present invention to provide a picture frame with means permitting a person to replace a picture to be displayed conveniently.

It is another objective of the present invention to provide a picture frame which can be used to display a picture in a longitudinal or horizontal manner.

In keeping with the principles of the present invention, the objectives of the present invention are accomplished by a picture frame, which comprises a frame, a back plate, a face plate, and a base. The frame of iron material provides an ornamental border surrounding a picture intended to be displayed. The back plate is made of a soft magnetic plate and is attached to one side of the frame by virtue of its magnetism. The face plate of transparent material is kept between the frame and the back plate in such a manner that it permits a picture intended to be displayed to be placed between it and the back plate. The base made of a flat plate is provided thereon three retaining strips of protruded construction, each of which forms a predetermined angle with the surface of the base. The left and the right retaining strips are aligned, while the one in the middle is arranged slightly toward the back side of the base. These retaining strips jointly form a retaining portion.

The objectives and the features of the present invention will be better understood by studying the following detailed description of a preferred embodiment of the present invention in conjunction with the drawings provided herewith.

DETAILED DESCRIPTION OF THE PREFERRED EMBODIMENT

Figure 1:
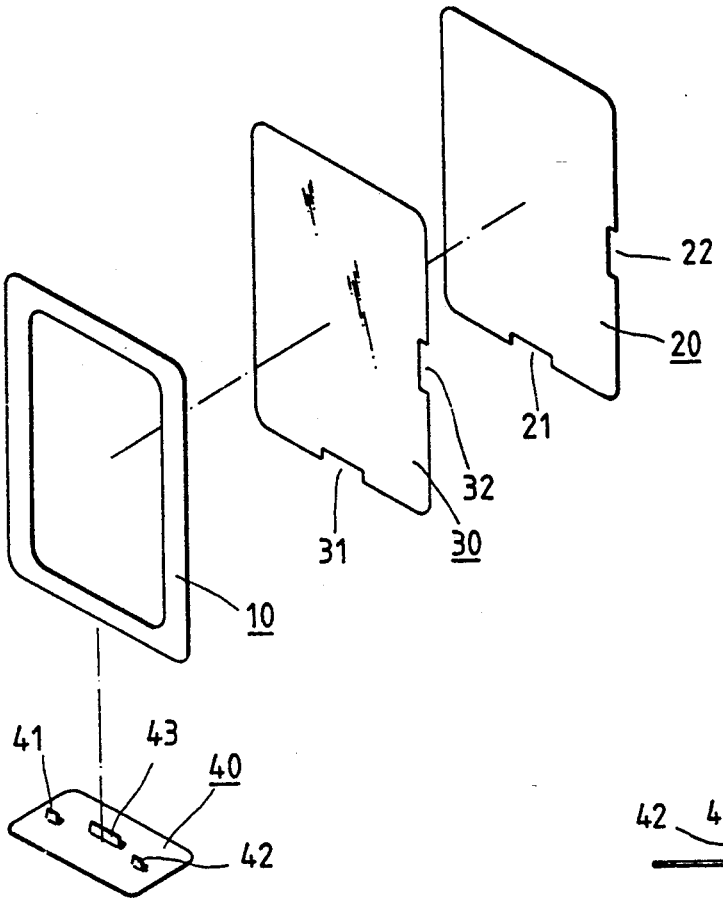
FIG. 1 shows an exploded view of the present invention.
Figure 2:
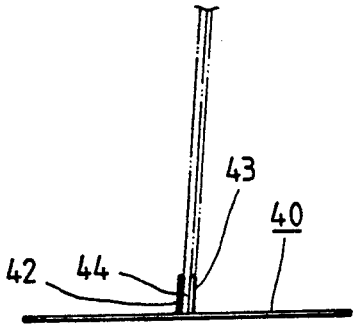
FIG. 2 shows a side view of the base of the present invention.

Referring to FIGS. 1 and 2, a picture frame embodied in the present invention is shown comprising a frame 10, a back plate 20, a face plate 30, and a base 40. The frame 10 of iron material is rectangular in shape and is provided with a space intended to keep a picture to be displayed. The back plate 20 is a magnetic flat plate made from soft material and provided with cut-outs 21 and 22 located respectively at the center of the bottom edge thereof and the left edge thereof. The face plate 30 is of a transparent flat plate of plastic material and is disposed between the frame 10 and the back plate 20. The picture intended to be displayed is kept between the face plate 30 and the back plate 20. Like back plate 20, the face plate 30 is provided with cut-outs 31 and 32 corresponding in location and shape to cut-outs 21 and 22 of the back plate 20. The base 40 is of flat construction and is provided thereon with three retaining strips 41, 42 and 43, each of which forms a predetermined angle with the surface of the base 40. The left and the right retaining strips 41 and 42 are aligned, while the middle retaining strip 43 is arranged slightly toward the rear side of the base 40. These three retaining strips 41, 42 and 43 jointly form a retaining portion 44 for use in holding the frame 10.

Figure 3:
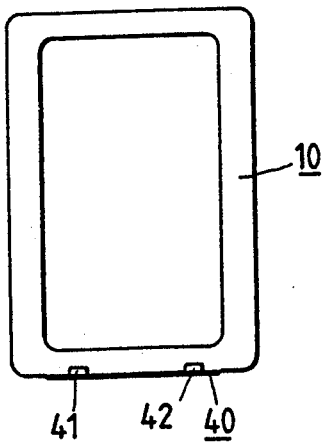
FIG. 3 shows a front view of the present invention in an upright position, with a short side of the frame standing on the base.
Figure 4:
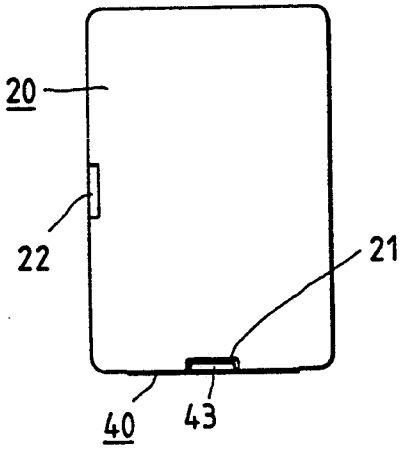
FIG. 4 shows a rear view of the present invention in an upright position, with a short side of the frame standing on the base.

As shown in FIGS. 3 and 4, the frame 10 can be kept in an upright position by the retaining portion 44 of the base 40. As a result, the left and the right retaining strips 41 and 42 remain in front of the frame 10, while the middle retaining strip 43 remains behind the frame 10. In other words, the frame 10 is retained securely in place by these three retaining strips 41, 42 and 43 in such a manner that it forms a predetermined angle with the base 40. The picture intended to be displayed is then sandwiched between the face plate 30 and the back plate 20. The face plate 30 and the back plate 20 along with the picture sandwiched therebetween can be made to join with the frame 10 by virtue of the magnetism of the back plate 20. In addition, the cut-out 21 of the back plate 20 and the cut-out 31 of the face plate 30 are designed to avoid the middle retaining strip 43 so as to ensure that the back plate 20, the face plate 30 and the picture sandwiched between the back plate 20 and the face plate 30 are attached securely to the frame 10.

Figure 5:
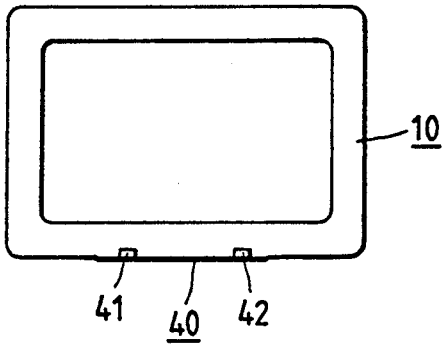
FIG. 5 shows a front view of the present invention in an upright position, with a long side of the frame standing on the base.
Figure 6:
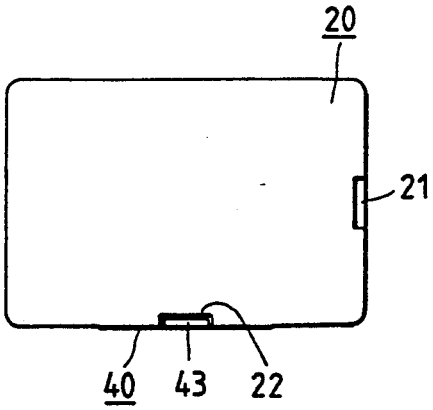
FIG. 6 is a rear view of the present invention as shown in FIG. 5.

As shown in FIGS. 5 and 6, the picture frame of the present invention can be displayed in such a manner that it stands on a long side thereof. This is done by inserting the long side of the frame 10 into the retaining portion 44 of the base 40 and subsequently by attaching magnetically the face plate 30 and the back plate 20 to the frame 10. The cut-out 22 of the back plate 20 and the cut-out 32 of the face plate 30 serve to avoid the middle retaining strip 43.

It is apparent that a display picture can be easily placed into or removed from the picture frame of the present invention by detaching the back plate 20 from the frame 10.

The embodiment of the present invention described above is to be considered in all respects as merely an illustration of principles of the present invention. Accordingly, the present invention is to be limited only by the scope of the hereinafter appended claims.

What is claimed is:

1. A picture frame comprising:

(a) a frame made of iron material and provided with an open space;

(b) a back plate made of magnetic soft material;

(c) a face plate of transparent material sandwiched between said frame and said back plate;

(d) a base of flat construction having thereon a retaining portion comprising a left retaining strip, a right retaining strip, and a middle retaining strip, each of which is arranged in such a manner that it forms a predetermined angle with said base, with said left retaining strip and said right retaining strip being aligned and said middle retaining strip being located in a plane slightly spaced from said left and right retaining strips closer toward a rear side of said base; and (e) wherein said back plate and said face plate comprise respectively a cut-out located along a center part of an edge thereof.

* * * * *